US006544151B2

(12) United States Patent
Tornabene

(10) Patent No.: US 6,544,151 B2
(45) Date of Patent: Apr. 8, 2003

(54) EXERCISE APPARATUS

(76) Inventor: Dean Tornabene, 4015 Glenco Ave. Unit No. 8, Marina Del Rey, CA (US) 90292

( * ) Notice: Subject to any disclaimer, the term of this patent is extended or adjusted under 35 U.S.C. 154(b) by 134 days.

(21) Appl. No.: 09/773,784

(22) Filed: Feb. 2, 2001

(65) Prior Publication Data

US 2002/0052269 A1 May 2, 2002

Related U.S. Application Data

(63) Continuation-in-part of application No. 09/704,242, filed on Nov. 2, 2000.

(51) Int. Cl.[7] ..... A63B 21/04
(52) U.S. Cl. ..... 482/122; 482/140
(58) Field of Search ..... 482/96–100, 111, 482/112, 122, 137, 130, 140, 142, 148, 101

(56) References Cited

U.S. PATENT DOCUMENTS 4,618,144 A 10/1986 Gibson
4,809,976 A 3/1989 Berger
5,100,131 A * 3/1992 Fong ..... 482/112
5,178,599 A 1/1993 Scott
5,334,120 A * 8/1994 Rasmussen ..... 482/97
5,342,269 A 8/1994 Huang et al.
5,356,358 A 10/1994 Chen
5,512,027 A 4/1996 Chen
5,575,714 A 11/1996 Fan
5,746,688 A * 5/1998 Prager ..... 482/142
5,938,571 A * 8/1999 Stevens ..... 482/96

* cited by examiner

*Primary Examiner*—Glenn E. Richman
(74) *Attorney, Agent, or Firm*—Howard A. Kenyon

(57) ABSTRACT

An exercise apparatus that exercises at least three groups of muscles is disclosed. The apparatus exercises the hamstring muscle, the quadriceps muscle and the maximus gluteus muscle. The apparatus utilizes a seated position for the person exercising and incorporates a padded portable seat sitting on a surface. The exercise apparatus also contains rectangular backrest. Two arms are also provided on each side of the exercise equipment. When a person pushes against the backrest, and pushes the arms forward, the exercise apparatus rotates lifting the person exercising off the surface such that the above three groups of muscles are exercised.

12 Claims, 3 Drawing Sheets

EXERCISE APPARATUS

This is a continuation-in-part of application Ser. No. 09/704,242, filed Nov. 2, 2000.

BACKGROUND OF THE INVENTION

1. Field of the Invention

This invention relates to an exercise apparatus and more particularly to the present invention which is directed to an exercise apparatus for the conditioning of the three groups of muscles, the hamstring muscle, the quadriceps muscle and the maximus gluteus muscle.

2. Description of the Prior Art

Many devices exist for exercising various parts of the body for commercial and home use. Some of these devices are:

U.S. Pat. No. 5,575,741 to Robert Fan.

This exercise apparatus simulates horse riding type and rowing type exercise.

U.S. Pat. No. 4,526,013 to W. R. Dofel.

This exercise device provides a mechanical resistance assembly which employs a resistant strap which is stretched by use of a pulley system pulled by the user.

U.S. Pat. No. 5,094,450 to Stearns.

This exercise machine provides for abdominal exercising. This machine also allows a chest pod to rotate, which is resisted by either a viscous fluid resistance or stacked weights.

U.S. Pat. No. 5,112,287 to Brewer.

This exercise apparatus employs a resistance that is experienced by a person exerting a force to pull or push the body engaging members. The resistance can be varied.

SUMMARY OF THE INVENTION

It is the object of the present invention to provide an exercise apparatus useful in connection with the performance of exercising at least three groups of muscles.

It is another object of the present invention to exercise the maximus gluteus muscle in addition to two leg muscles.

It is yet another object of the present invention to provide an exercise apparatus that can be efficient and economically manufactured.

Briefly, in accordance with the present invention, there is provided an exercise apparatus that has a portable padded seat sitting on a surface in front of the exercise apparatus which also sits on the surface. The exercise apparatus has a rectangular backrest and two arms on each side connected to the lower end of the backrest frame. The arms extend forward on each side of the portable seat and have rollers on the end of the forward extension of the arms whereby the rollers rest on the surface that the exercise apparatus also rests. The arms extend forward and have handles on the upper end that the person exercising can grasp. Two semicircular members attached to the backrest also sit on the surface. Pivotally attached to the backrest is a brace that has a roller resting on the surface on the other end. The brace has a sliding member that is fitted over the brace and the sliding member is adjusted by push pins. The sliding member adjusts the tension in the tensioning members. When a person exercising pushes grasps the handles and pushes forward and simultaneously pushes back on the backrest, the backrest rotates and lifts the person exercising off of the surface. The person exercising pushes back as far as desired and then relaxes and the person exercising will return to sit on the portable seat. This movement is repeated as many times as desired until a complete workout is obtained in the three previously mentioned muscle groups. It is noted that a person exercising must hold their feet flat on the surface.

These and other objects, features and advantages of the present invention will become more readily apparent upon detail consideration of the following Description of the Preferred Embodiment with reference to the accompanying drawings.

DESCRIPTION OF THE DRAWINGS

In the drawings that illustrate the best mode presently contemplated for carrying out the present invention are.

The novel features which are believed to be characteristic of the invention, both as its organization and its method of operation, together with further objects and advantages thereof, will be better understood from the following description in connection with the accompanying drawings in which a presently preferred embodiment of the invention is illustrated by way of example. It is expressly understood, however, that the drawings are purposes of illustration and description only, and are not intended as a definition of the limits of the invention.

DESCRIPTION OF THE PREFERRED EMBODIMENT

Figure 1:
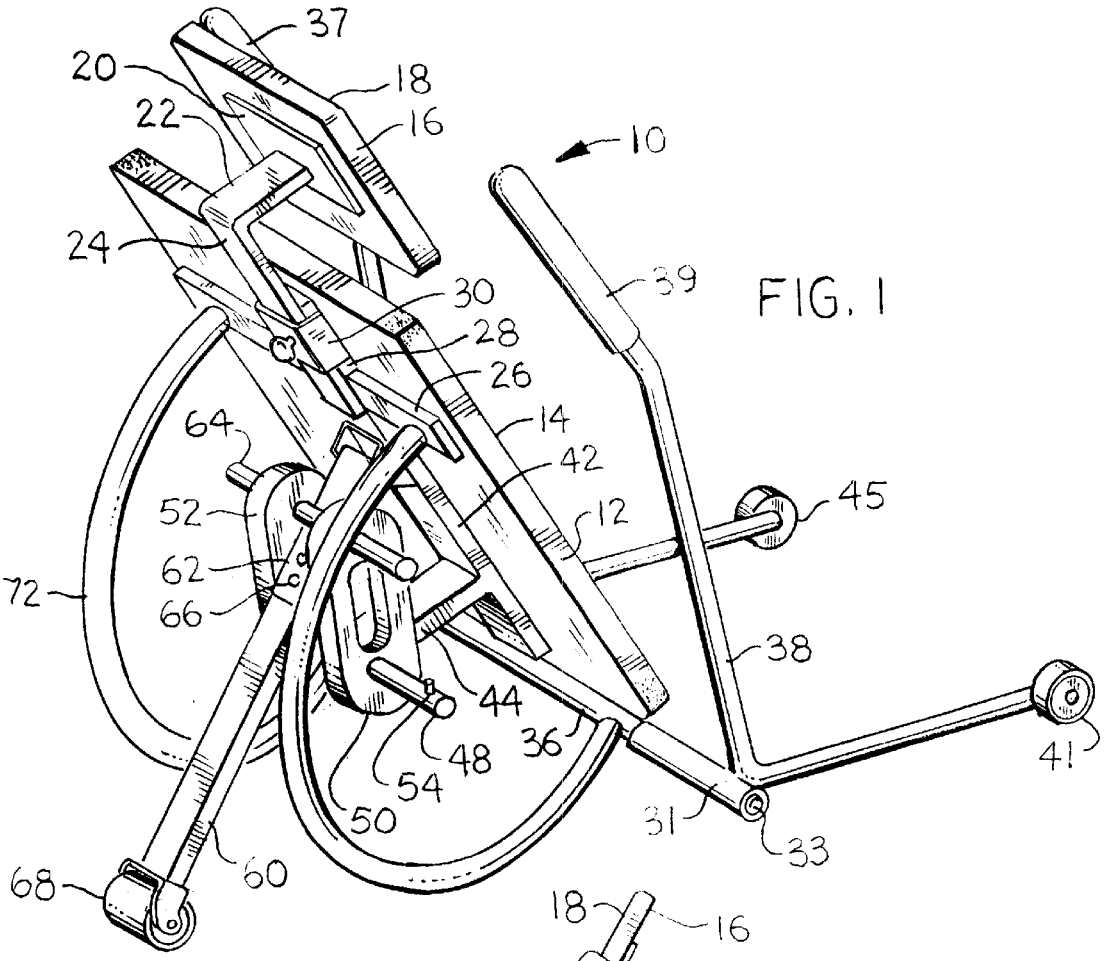
FIG. 1 is an isometric view of the present invention showing the back of the present invention.

Turning now to FIG. 1 there is seen a perspective view of the present invention generally shown as 10. The backrest 12 made of a solid material has cushioning material on the front side which is also covered with a waterproof material 14. The headrest 16, also made of solid material, is covered with a cushioning material and also covered with a waterproof material 18. The headrest 16 has a structural member 20 attached to the back of the headrest 16. The structural member 20 has attached thereto a structural member 22 that is further attached at 90 degrees to another structural member 24. The backrest 14 has attached a horizontal structural member 26 which has a vertical structural member 28 attached only to the horizontal structural member 26. Vertical structural member 28 is not attached to the backrest 14. A bracket 30 is fitted around both structural member 24 and structural member 28 whereby structural member 24 may slide up or down to adjust headrest 16 to the requirement of the person exercising. Once the adjustment is made, thumb screw 32 can be tightened to hold the headrest 16 in place.

Figure 2:
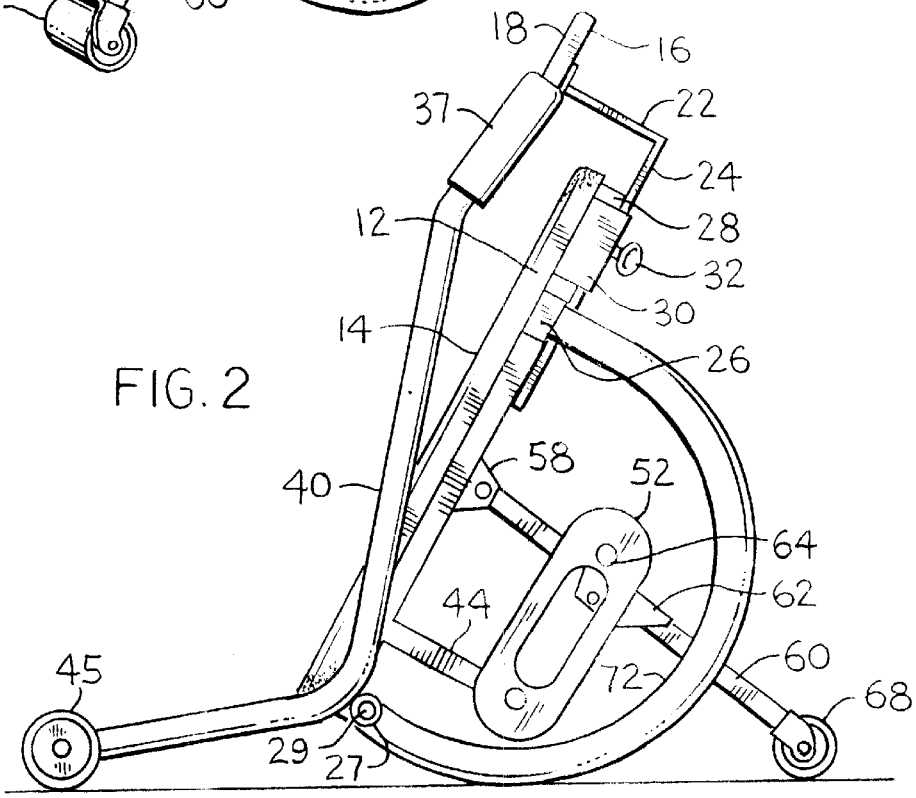
FIG. 2 is a left side view of the present invention.

Attached to the structural member 42 is a rod 36. Rod 36 has attached on one end a sleeve 31 which rotates on rod 36. A threaded cap 33 holds sleeve 31 onto rod 36. Arm 38 is attached to rotating sleeve 31 to provide rotating means for arm 38. Arm 40 (which is not seen in FIG. 1 but is seen in FIG. 2) has a rotating sleeve 27 which is attached to rod 40 and provides rotating means for rod 40. Threaded cap 29 holds sleeve 27 onto rod 36. Arm 38 has attached to the top of arm 38 a hand grip 39. Arm 38 has also attached a roller 41 on the bottom end. Arm 40 has attached to the top of arm 40 a hand grip 37. Arm 40 has also attached a roller 45 on the bottom end. The backrest 12 has attached a vertical structural member 42 which has a horizontal structural member 44 attached 90 degrees to vertical structural member 42. Attached to horizontal structural member 44 is a rod 48 that holds one end of elastomer members 50 and 52. Bar 48 has push pins 54 and 56 (not shown) to prevent the elastomer members 50 and 52 from coming off rod 48. Vertical structural member 42 has affixed thereto a bracket 58 that pivotally holds a brace 60. Brace 60 has a sleeve 62 that slides along brace 60. Sleeve 62 has affixed thereto rod 64 that holds one end of elastomer members 50 and 52. Sleeve 62, when slid along brace 60, provides tensioning of elastomer members 50 and 52. The adjustment is held in place by push pins 66 protruding through a hole in sleeve 62.

On the bottom end of brace 60 there is a roller 68 that rolls on the surface. FIG. 1 also shows semi-circular members 70 and 72 that are covered with a non-slip material. Semi-circular members 70 and 72 also sit on the surface.

FIG. 2 shows a left side view of the present invention. In this view arm 40 having hand grip 37 and roller 45 is also seen.

Figure 3:
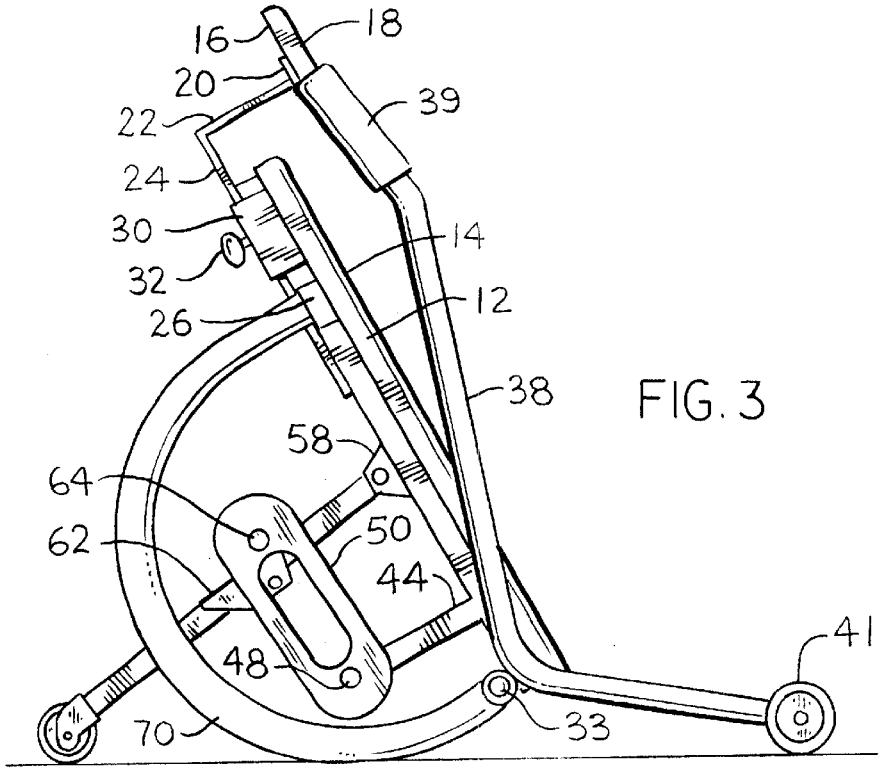
FIG. 3 is a right side view of the present invention.

FIG. 3 shows a right side of the present invention.

Figure 4:
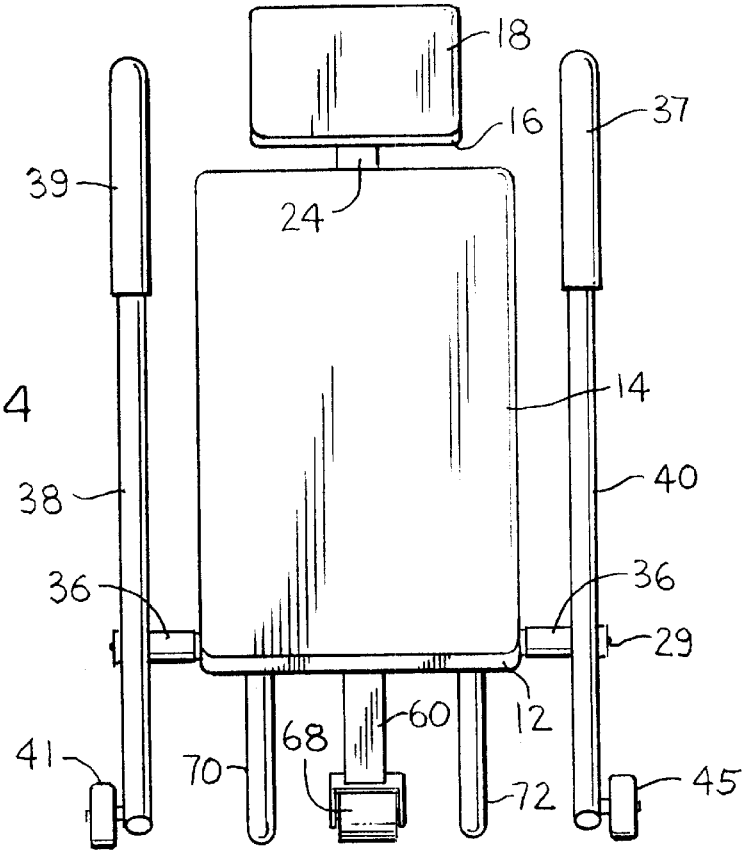
FIG. 4 is a front view of the present invention.

FIG. 4 shows a front view of the present invention.

Figure 5:
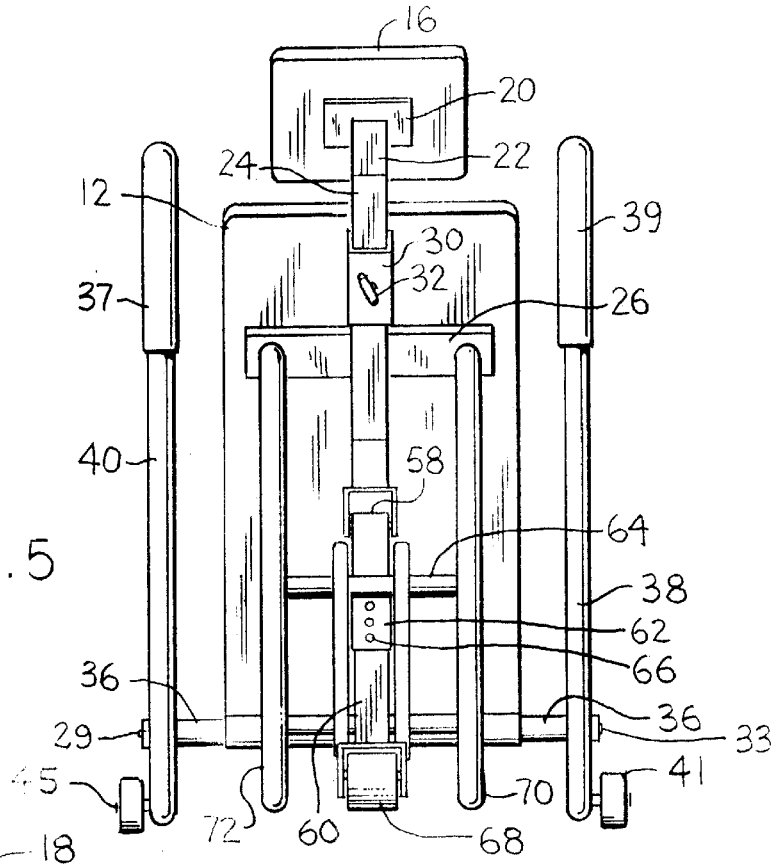
FIG. 5 is a rear view of the present invention.

FIG. 5 shows a rear view of the present invention.

Figure 6:
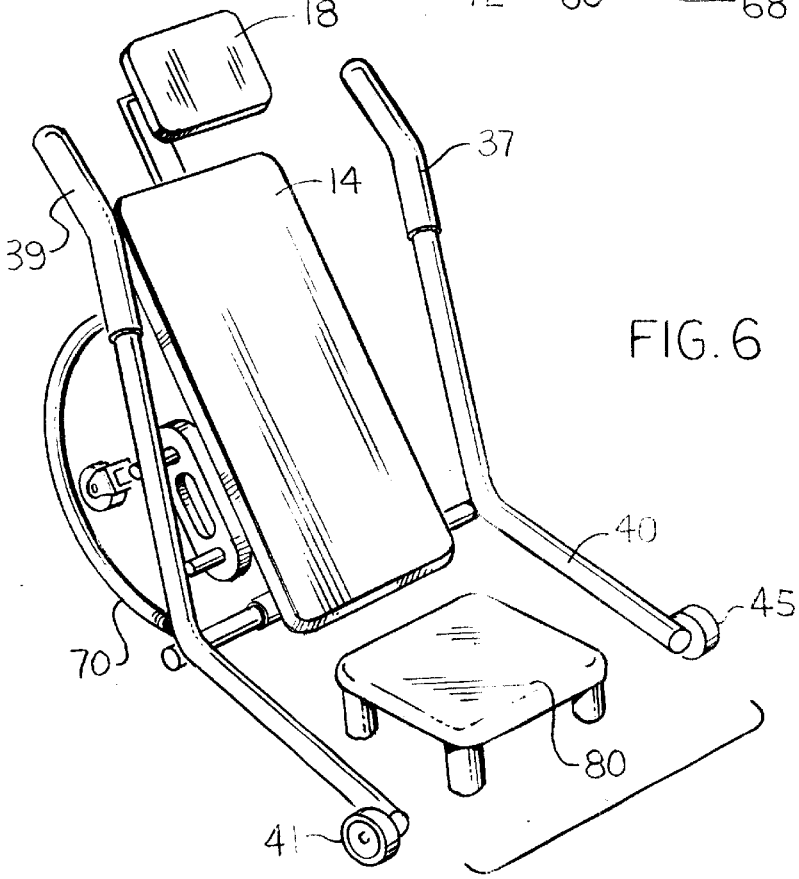
FIG. 6 is a front isometric view of the present invention showing the portable seat in front of the present invention.

FIG. 6 shows the present invention with the portable seat 80 in front of the present invention.

The operation of the exercise apparatus is very easy. When the person exercising sits on the portable seat 80 and puts their hands on the hand grips 37 and 39, the person exercising also places their back on the backrest and their head on the headrest. The person exercising then pushes back with their back and forward with their arms and the exercise apparatus rotates on the semi-circular members 70 and 72. Simultaneously rollers 41 and 45 and roller 68 rotates on the surface and this motion provides a tension in elastomer members 50 and 52. The motion of pushing back by the person exercising and pushing forward with their arms lifts the person exercising off the portable seat 80 and the rotation of the exercise apparatus on the surface increases the tension in the elastomer members 50 and 52. This movement of the person exercising, exercises the three groups of muscles previous indicated. When the person relaxes, the exercise apparatus returns to the initial position. This movement is repeated until a complete workout is obtained.

The present disclosure includes that contained in the appended Claims as well as that of the aforegoing description. Although this invention has been described in this preferred form, with a certain degree of particularity, it is understood that the present disclosure of the preferred form has been made by way of example and that numerous changes in the details of construction and the combination and arrangement of parts maybe resorted to without departing from the spirit and scope of the invention.

What is claimed is:

1. An exercise apparatus for exercising, at least, the hamstring muscle, the quadriceps muscle and the maximus gluteus muscle comprising:

a rectangular backrest having a front side and a back side;

a headrest attached to said back side of said rectangular backrest, said headrest having a front side and a back side;

two arms connected to each side of said exercise apparatus, said arms having rollers that are in contact with a surface;

two semi-circular members, said semi-circular members being covered with a non-slip material, said semi-circular members also being in contact with said surface;

a horizontal structural member attached to said back side of said rectangular backrest;

a vertical structural member attached to said back side of said rectangular backrest, said vertical structural member further attached on one end to said horizontal structural member;

a brace member, said brace member being pivotally attached on one end to said vertical structural member;

a horizontal rod attached to said vertical structural member;

tensioning members;

a portable seat sitting in front of said exercise apparatus.

2. An exercise apparatus as described in claim 1 wherein said rectangular backrest and said headrest has cushioning material attached thereto on front side of said rectangular backrest and said front side of said headrest, said cushioning material being covered with a waterproof covering.

3. An exercise apparatus as described in claim 1 wherein said semi-circular members are attached 90 degrees to said backrest, one end of said semi-circular member being attached to said horizontal rod and one end of said semi-circular members being attached to said horizontal structural member which is further attached to said backrest.

4. An exercise apparatus as described in claim 1 wherein said brace member being pivotally attached to said vertical structural member on one end, said brace member having roller means on one end, said roller means being in contact with said surface.

5. An exercise apparatus as described in claim 1 wherein said vertical structural member is attached to said backrest and has a horizontal structural member that is permanently attached to said vertical member at 90 degrees, said horizontal structural member being also attached to one end of a bar holding an end of said tensioning members, said bar having a push pin on each end to keep said tensioning member from coming off of said bar.

6. An exercise apparatus as described in claim 1 wherein said brace member has attached thereto a sliding member fitted over said brace member, said sliding member having push pins means for adjustment of said tensioning members.

7. An exercise apparatus as described in claim 6 wherein said sliding member has attached thereto a bar holding an end of said tensioning members.

8. An exercise apparatus as described in claim 1 wherein said headrest has a structural member attached to said headrest, said structural member of said headrest providing vertical adjustment of said headrest by sliding said structural member of said headrest vertically between a bracket and said vertical structural member, said bracket having a screw that is tightened when a person exercising obtains the correct headrest position.

9. An exercise apparatus as described in claim 4 wherein said roller means is sufficiently large to roll either on a hard surface or a soft surface.

10. An exercise apparatus as described in claim 1 wherein a person exercising sits on said portable stool and places their back on said front side of said backrest, said person exercising placing their feet flat on said surface, said person exercising placing their hands on said two arms, said person exercising pushing with their back backward on said front side of said backrest, said person exercising rotating said exercise apparatus by pushing said two arms forward which in turn will lift said person exercising off of said portable stool, said person rotating said exercise apparatus to a selected position.

11. An exercise apparatus as described in claim 10 when said person exercising relaxes which in turn will allow said exercise apparatus to reverse and place said person exercising back on said portable stool.

12. An exercise apparatus as described in claim 10 wherein said person rotating said exercise apparatus to a selected position will exercise said hamstring muscles, said quadriceps muscles, and said maximus gluteus muscles.

* * * * *